US006637868B2

(12) United States Patent
Yamamoto et al.

(10) Patent No.: US 6,637,868 B2
(45) Date of Patent: Oct. 28, 2003

(54) INKJET HEAD AND METHOD OF MANUFACTURING THE SAME

(75) Inventors: Ryoichi Yamamoto, Kanagawa (JP); Seiichi Inoue, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 99 days.

(21) Appl. No.: 10/042,275

(22) Filed: Jan. 11, 2002

(65) Prior Publication Data

US 2003/0056721 A1 Mar. 27, 2003

(30) Foreign Application Priority Data

Jan. 12, 2001 (JP) ..... 2001-005444

(51) Int. Cl.[7] ..... B41J 2/045; B41J 2/135; B41J 2/14; B41J 2/16

(52) U.S. Cl. ..... 347/68; 347/45; 347/47

(58) Field of Search ..... 347/68, 45, 47, 347/64; 29/890.1

(56) References Cited

U.S. PATENT DOCUMENTS 5,949,454 A * 9/1999 Nozawa et al. ..... 347/45

6,375,858 B1 * 4/2002 Makigaki et al. ..... 216/27

FOREIGN PATENT DOCUMENTS

JP 10-151744 9/1998

* cited by examiner

*Primary Examiner*—Thinh Nguyen
(74) *Attorney, Agent, or Firm*—Whitham, Curtis & Christofferson, P.C.

(57) ABSTRACT

An inkjet head is disclosed which an ink ejection unit and a plate including an ink ejection nozzle disposed in correspondence to the ink ejection unit. The plate contains fine particles that have a water-repellent function in at least a region near to a surface of the plate, the fine particles being dispersed therein. The plate is arranged by etching using at least two kinds of etching conditions which differ in magnitude relation between an etching rate of the fine particles in the region and an etching rate of portion of the plate excluding the fine particles in the region, to form the ink ejection nozzle and a surface of the plate in the vicinity of an ink ejection opening of the ink ejection nozzle. The fine particles, for example mainly comprises silicone. The surface of the plate formed by etching is a fine irregular surface where the fine particles are exposed, and an inner surface of the ink ejection nozzle formed by etching is a flat surface with no fine irregular portion.

11 Claims, 2 Drawing Sheets

INKJET HEAD AND METHOD OF MANUFACTURING THE SAME

BACKGROUND OF THE INVENTION

The present invention relates to an inkjet head for performing recording operation by jetting ink droplets onto a recording medium and to a method of manufacturing the inkjet head.

Nowadays, inkjet printers for performing recording operation by ejecting ink droplets of water base ink have come into widespread use. In such circumstances, it is strongly desired that the inkjet printers can print and output an image of high quality like a photograph at a high speed.

To cope with this requirement, various technologies have been proposed to improve the quality of an image output by an inkjet printer and to improve the print speed of the inkjet printer. For example, an inkjet head having a water-repellent processed layer disposed in the vicinity of the ink ejection opening of ink ejection nozzles so that ink droplets can be correctly ejected and jetted in desired directions and that an image of high quality can be printed thereby at a high speed.

JP 10-151744 A proposes to coat fluorine polymer in the vicinity of the ink ejection openings of ink ejection nozzles.

FIG. 6 shows an arrangement corresponding to an ink ejection nozzle of an inkjet head in the publication. FIG. 7 shows an enlarged view of a region C shown in FIG. 5.

According to the publication, a heat generation resistor 102 and thin film conductors 104 and 106 are disposed on a substrate 100 and an individual ink path 110 is formed by disposing a partition layer 108 on the substrate 100, and a plate 114 having an inkjet nozzle 112 is bonded on the partition layer 108. Then, a water-repellent processed layer 116 is disposed by coating fluorine polymer in the vicinity of the ejection opening 112*a* of the inkjet nozzle 112 of the plate 114. In particular, as shown in FIG. 7, water repellency is more improved by making the surface of the water-repellent processed layer 116 into a fine irregular surface 118 of 30 to 60 nm.

In the inkjet head disclosed in the publication, however, the water-repellent processed layer 116 is rubbed with a cleaning blade to clean and remove ink and the like, which is a part of ink droplets jetted onto a recording sheet to be printed thereon, sprung back therefrom and deposited in the vicinity of the ink ejection opening of the ink ejection nozzle 112. Thus, the water-repellent processed layer 116 is worn as the number of times of cleaning increases. Accordingly, when the inkjet printer is used for a long period of time, the water-repellent processed layer 116 is worn out, the plate 114 that is poor in water repellency begins to appear, and a part of ink droplets sprung back from the recording sheet is liable to deposit in the vicinity of the ejection opening of the ink ejection nozzle 112. As a result, a problem arises in that the ejecting directions of ink droplets ejecting from the ink ejection nozzle 112 are disturbed, and thus the ink droplets do not reach the desired positions of the recording sheet and an image of high quality cannot be printed.

This problem arises not only in an inkjet head employing a heating system, in which a heat generation element is used as an actuator for ejecting ink droplets, but also in an inkjet head employing a piezoelectric system in which a piezoelectric device such as a piezoelectric element, and the like is used as an actuator for ejecting ink droplets in the same way.

SUMMARY OF THE INVENTION

Accordingly, an object of the present invention, which was made to solve the above problem, is to provide an inkjet head that has a plate through which ink ejection nozzles are disposed to eject ink droplets, is provided with water repellency (ink repellency) to ink droplets at a desired position which is maintained even if the inkjet head is used for a long period of time, and can output a print of high quality, and to provide a method of manufacturing the inkjet head.

The present invetion provides an inkjet head, comprising: an ink ejection unit; and a plate including an ink ejection nozzle disposed in correspondence to the ink ejection unit so that an ink droplet is ejected from the ink ejection nozzle using the ink ejection unit, wherein, fine particles which have a water-repellent function are dispersed in at least a region in proximity to a surface of the plate on an ink ejection side thereof; and wherein the plate is etched using at least two kinds of etching conditions which differ in magnitude relation between an etching rate of the fine particles in the region and an etching rate of the portion of the plate other than the fine particles in the region, and thereby the ink ejection nozzle and the surface of the plate in a vicinity of an ink ejection opening of the ink ejection nozzle are formed.

It is preferable that the plate is arranged such that the fine particles are dispersed in a plate base member, and the plate is etched using an etching condition in which an etching rate of the plate base member is approximately equal to that of the fine particles and an etching condition in which an etching rate of the plate base member is faster than that of the fine particles.

The fine particles having the water-repellent function preferably comprises silicone.

It is also preferable that a fine irregular surface where the fine particles are exposed is formed on the surface of the plate in the vicinity of the ink ejection opening of the ink ejection nozzle.

It is still also preferable that a flat surface with no fine irregular portion is formed on an inner surface of the ink ejection nozzle.

The present invention provides an inkjet head, comprising: an ink ejection unit; and a plate including an ink ejection nozzle disposed in correspondence to the ink ejection unit so that an ink droplet is ejected from the ink ejection nozzle using the ink ejection unit, wherein the plate is arranged such that fine particles, which comprises silicone, are dispersed in a plate base member.

Then, it is preferable that the plate is etched using an etching condition in which an etching rate of the plate base member is approximately equal to that of the fine particles and an etching condition in which an etching rate of the plate base member is faster than that of the fine particles.

The present invention also provides an inkjet head, comprising: an ink ejection unit; and a plate including an ink ejection nozzle disposed in correspondence to the ink ejection unit so that an ink droplet is ejected from the ink ejection nozzle using the ink ejection unit, wherein the plate contains fine particles having a water-repellent function and dispersed therein, and the dispersion density of the fine particles on a back side of the plate opposite to an ink ejection side thereof from which the ink droplet is ejected is lower than that of the fine particles on the ink ejection side.

The present invention still also provides a method of manufacturing an inkjet head comprising an ink ejection unit disposed on a substrate and a plate including an ink ejection nozzle disposed in correspondence to the ink ejection unit and containing fine particles, which have a water-repellent function and are dispersed in at least a region in proximity to a surface of the plate on an ink ejection side thereof, so that an ink droplet is ejected from the ink ejection nozzle using the ink ejection unit, the method comprising the steps of: bonding the plate along the substrate before the ink ejection nozzle is formed through the plate; forming the ink ejection nozzle under a first etching condition in which an etching rate of the fine particles in the region in proximity to the surface and an etching rate of a portion of the plate other than the fine particles in the region have predetermined magnitude relation so that the inner surface of the ink ejection nozzle is arranged as a flat surface; and etching the surface of the plate under a second etching condition which has magnitude relation different from the magnitude relation of the first etching condition so that the surface of the plate in a vicinity of an ink ejection opening of the thus formed ink ejection nozzle is arranged as a fine irregular surface on which the fine particles are exposed.

Then, it is preferable that the first etching condition is such that the etching rate of the fine particles in the region in proximity to the surface is approximately equal to that of the portion of the plate other than the fine particles, and the second etching condition is such that an etching rate of the portion of the plate other than the fine particles is faster than that of the fine particles.

It is also preferable that the ink ejection nozzle is formed by dry etching using a gas containing oxygen and fluorine as a reaction gas, and the surface of the plate is processed by dry etching using an oxygen gas as a reaction gas.

DETAILED DESCRIPTION OF THE INVENTION

An inkjet head of the present invention will be described below in detail with reference to a preferable embodiment shown in the accompanying drawings.

Figure 1:
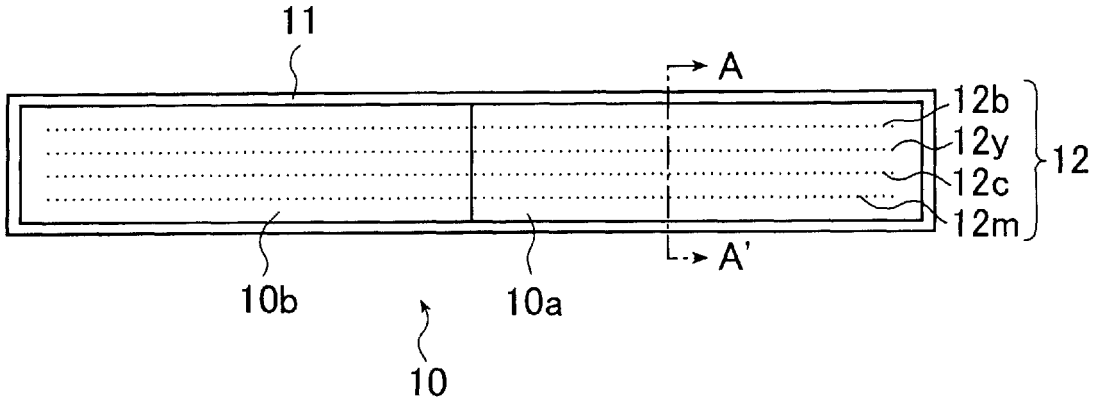
FIG. 1 is a plan view of a preferable embodiment of an inkjet head of the present invention when it is viewed from an ink ejection nozzle surface.
Figure 2:
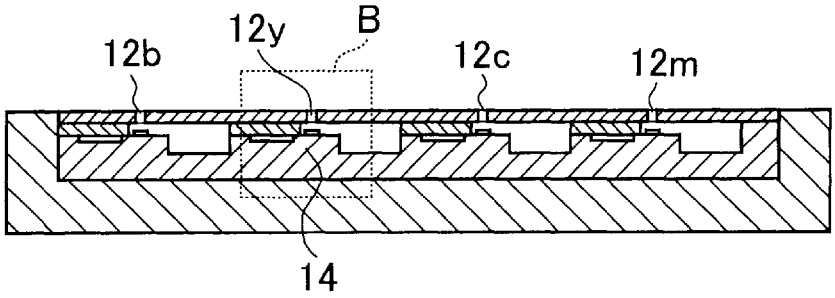
FIG. 2 is a sectional view showing a cross section of the inkjet head taken along the line A–A' shown in FIG. 1.

FIG. 1 shows an inkjet head 10 as an example of the inkjet head of the present invention. FIG. 2 shows a sectional view of the inkjet head taken along the line A–A' shown in FIG. 1.

The inkjet head 10 is arranged as a line head for an A4 size full color inkjet printer. The inkjet head 10 is constructed such that substrates 10*a* and 10*b*, which are monolithic silicon substrates obtained from a 6 inch wafer, are abutted against each other at a center of the inkjet head 10 and mounted on a mounting frame 11.

Disposed on the surfaces of the substrates 10*a* and 10*b* is a nozzle train 12 composed of a black nozzle train 12*b*, a yellow nozzle train 12*y*, a cyan nozzle train 12*c*, and a magenta nozzle train 12*m* in each of which 6048 ink ejection nozzles are disposed at a density of, for example, 720 dpi (dot/inch). Consequently, the nozzle train 12 includes 24192 ink ejection nozzles in total which are disposed in a length of 210 mm.

Figure 3:
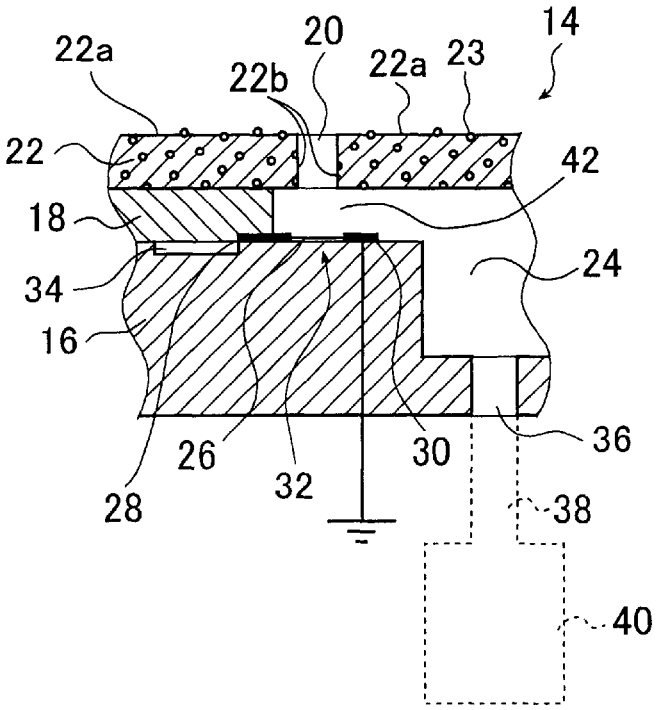
FIG. 3 is an enlarged sectional view of a region B of the inkjet head shown in FIG. 2.

As shown in FIG. 2, the substrates 10*a* and 10*b* include similar ink ejection mechanisms each of which corresponds to an ink ejection nozzle of each of the nozzles trains for the respective colors. Each of the ink ejection mechanisms includes, as shown in FIG. 3, a heat generation element 32 and an individual ink path 42 which will be described below. The ink ejection mechanisms will be described below with reference to an ink ejection mechanism 14 corresponding to the ink ejection nozzle shown in a region B of FIG. 2 as an example.

FIG. 3 shows the ink ejection mechanism 14.

The ink ejection mechanism 14 is arranged as a three-layer structure in which a substrate 16 composed of silicon, pyrex glass, or the like, a partition layer 18, and a plate 22, through which an ink ejection nozzle 20 is defined, are laminated.

An ink supply path 24 is formed in the substrate 16 by processing, for example etching the substrate 16 in a size of, for example, 150 $\mu$m and allocated to each of the nozzle trains 12*b*, 12*y*, 12*c*, and 12*m* of the nozzle train 12. Further, in FIG. 3, a heat generation resistor 26 is formed just below the ink ejection nozzle 20 of the plate 22 by sputtering.

Coupling ink holes 36 are intermittently defined through the bottom surface of the ink supply path 24. The ink supply path 24 links with an ink tank connecting path 38 connected to an ink tank 40 in which water base ink is stored, thereby ink is supplied to the ink supply path 24 at all times.

Wiring conductors 28 and 30 are electrically connected to the heat generation resistor 26 for applying a pulse voltage thereto. The wiring conductor 28 is electrically connected to the collector electrode of a driving LSI 34 having a shift resistor circuit and a driver circuit through a through-hole connecting portion (not shown) that traverses an etching resistant layer and a heat insulating layer (both of them are not shown) which are disposed on the substrate 16. Further, the wiring conductor 30 is grounded.

The driving LSI 34 is electrically connected to a total of four lines, that is, to a data line, a clock line, and two power supply lines all of which are wired from a printer controller (not shown). Further, a ground line wired from a side of the substrate 10*a* or 10*b* is connected to the wiring conductor 30 of the heat generation element 32.

The partition layer 18 is disposed on the substrate 16 and forms the individual ink path 42 and the ink supply path 24. The partition layer 18 is formed by bonding a water resistant film resist on the substrate 16 and removing the resist of portions of the individual ink path 42 and the ink supply path 24. The partition layer 18 covers a part of the wiring conductor 28 as well as the driving LSI 34. While the water resistant film resist is used as the partition layer 18 in the embodiment, polyimide may be used in place of it.

The plate 22 has the ink ejection nozzle 20, and fine particles 23, which are mainly composed of silicone (polysiloxane) and have a water-repellent function, are uniformly dispersed in the plate base member of the plate 22. Water repellency means a state in which an ink droplet has a contct angle of at least 90°.

A resin material, which is widely used in a polymer film, use used as the plate base member. For example, thermosetting resins such as polyimide, polyurethane resin, etc., thermoplastic resins such as polysulfone, etc., and further aramid resin are used as the plate base member.

It is preferable that the particle size of the fine particles 23 dispersed in the plate base member be 1 μm or less and that the dispersion density of the fine particles 23 in the plate base member be $3\times10^7$ pieces/mm$^3$ or more.

The fine particles 23 are exposed on the surface of the plate 22 on the ink ejection side (front surface side) of the ink ejection nozzle 20 and form a fine irregular surface 22*a*. Therefore, the fine irregular portion of the fine irregular surface 22*a* has a size corresponding to the particle size of the fine particles 23. It is preferable to form fine irregular portion in a size of 1 μm or less. The fine irregular surface 22*a* may be formed on the entire front surface of the plate 22 on the ink ejection side of the ink ejection nozzle 20 or may be formed within a predetermined range of the ink ejection opening of the ink ejection nozzle 20.

A reason why the fine particles 23 are exposed in the vicinity of the ink ejection opening of the ink ejection nozzle 20 and the fine irregular surface 22*a* is formed is to provide water repellency (ink repellency) with water base ink by mainly composing the fine particles 23 of silicone having a water repellant function and further to realize ultra ink repellency by setting the contact angle of an ink droplet to 90° or more and preferably to 120° or more by the shape effect of the fine irregular portion.

The fine irregular surface 22*a* is formed by dry etching or wet etching under an etching condition in which the etching rate of the plate base member of the plate 22 is faster than that of the fine particles 23. For example, in the dry etching, the plate base member is formed by being selectively processed by reactive ion etching.

The etching rate of the plate base member that is faster than that of the fine particles 23 means such a difference of etching rate that when the surface of the plate base member is processed at the faster etching rate, the formation of a fine irregular surface is permissible on the plate base member having been processed.

Further, the fine particles 23 are not exposed on the inner surface of the ink ejection nozzle 20, and a flat surface 22*b* with no fine irregular portion is formed on the inner surface such that the surface of the fine particles 23 is flush with the plate base member. The ink ejection nozzle 20 is formed in such a manner that the plate 22 without ink ejection nozzle is bonded on the partition layer 18, and then holes are formed through the plate 22 by subjecting the plate base member and the fine particles 23 to dry etching or wet etching under an etching condition in which the etching rate of the plate base member is approximately the same as that of the fine particles 23. Accordingly, the plate base member and the fine particles 23 are etched without disctrimination. The holes are defined by, for example, reactive ion etching as described later.

The etching rate of the plate base member is substantially the same as that of the fine particles 23 means that the difference between etching rates of the plate base member and of the fine particles 23 is so small that the processed surface is permissible as a flat surface.

A reason why the flat surface 22*b* with no fine irregular portion is formed on the inner surface of the ink ejection nozzle 20 as described above is as described below. That is, it is preferable not to realize the ultra ink repellency on the inner surface of the ink ejection nozzle 20 to permit ejected ink droplets to smoothly pass through the inner surface when they come into contact therewith. Accordingly, the angle at which ink comes into contact with the flat surface 22*b* is set to 120° or less and more preferably to 90° or less.

Further, the back surface of the plate 22 which is opposite to ink ejection opening of the ink ejection nozzle 20, is arranged as a flat surface where the fine particles 23 are not exposed. A reson why the back surface of the plate 22 is arranged as the flat surface is to permit the plate 22 to be bonded on the partition layer 18 well through an adhesive which can be thinly coated on the overall back surface without the ultra ink repellency being realized on the back surface.

The plate 22 having the fine irregular surface 22*a* and the flat surface 22*b* is formed by, for example, dry etching in the following manner. That is, the fine particles 23 are previously dispersed approximately uniformly in the plate base member that constitutes the plate 22, and the plate 22 is bonded on the partition layer 18 using a heat curing type adhesive, an ultraviolet curing type adhesive, or the like. Subsequently, the plate 22 is subjected to plasma reactive dry etching in a known reactive dry etching apparatus using $O_2$ and $CF_4$ as a reactive gas so as to form the ink ejection nozzle 20 (to define the hole) through the plate 22. Since $O_2$ and $CF_4$ are used as the reactive gas when the ink ejection nozzle 20 is formed, the fine particles 23 mainly composed of silicone and the plate base member are etched unselectively at approximately the same etching rate. Accordingly, the flat surface 22*b* is formed on the inner surface of the ink ejection nozzle 20.

Next, the surface of the plate 22 on the ink ejection side thereof is subjected to plasma reactive dry etching in the same reactive dry etching apparatus using $O_2$ as a reactive gas. At this time, the etching rate of the plate base member of the plate 22 is made faster than that of the fine particles 23 because $O_2$ is used as the reactive gas, and thereby the plate base member is selectively etched and the fine particles 23 composed of silicone is not etched. Therefore, the fine particles 23 are exposed on the surface on ink ejection side of the plate 22 and the fine irregular surface 22*a* is formed thereon.

It should be noted that while the gas containing $O_2$ and $CF_4$ is used as the reactive gas to form the hole of the ink ejection nozzle 20, the reactive gas is not limited thereto and any reactive gas may be used so long as similalry etching rates can be obtained thereby. A gas containing fluorine such as $C_2F_6$, $SF_6$, etc. for example, may be used in place of $CF_4$. Note that, in the present invention, the etching condition under which etching rates are made approximately the same in dry etching includes not only conditions such as a type and a composition ratio of the reactive gas but also various conditions such as a pressure and a temperature of a dry etching apparatus and a frequency of a high frequency power supply to be applied. In wet etching, the etching condition also includes a composition ratio and a temperature of an etching liquid, and the like.

The plate 22 is formed as described above.

The above embodiment employs the heat generation element 32 for boiling the ink and ejecting an ink droplet from the ink ejection nozzle 20 acting as an ink ejection unit. However, the ink ejection unit in the present invention may employ a piezoelectric system for ejecting an ink droplet by varying the volume of a piezoelectric device such as a piezoelectric element, and the like according to a predetermined voltage.

Further, the embodiment employs a top shooter system, in which the plate 22 having the ink ejection nozzle 20 is disposed along the surface of the substrate 16 and an ink droplet is ejected from the ink ejection nozzle 20 in an approximately vertical direction with respect to the surface of the heat generation resistor 26 of the heat generation element 32 disposed on the substrate 16. However, the present invention may employ a side shooter system in which an ink droplet is ejected in approximately parallel with the surface of the heat generation resistor of the heat generation element.

In the ink ejection mechanism 14, the heat generation element 32 generates heat in response to a signal supplied from a printer controller (not shown) through a data line and heats and vaporizes the ink liquid located over the heat generation resistor 32 of the individual ink path 42 to thereby generate a bubble. The bubble abruptly expands, pushes upward the ink in the ink ejection nozzle 20, and ejects an ink droplet. Thereafter, the expanded bubble communicates with atmosphere in the opening of the ink ejection nozzle 20 as well as is cooled by adiabatic expansion, begins to shrink, and then disappears. With this operation, one ejection of an ink droplet is completed.

A surface having the fucntion of the ultra ink repellency is formed on the surface of the vicinity of the ink ejection opening of the ink ejection nozzle 20 because the fine particles 23 having the water-repellent function are exposed on the surface and further the fine irregular surface 22*a* is formed thereon. Thus, even if ink droplets ejected from the ink ejection nozzle 20 onto a recording sheet are partly sprung back to surface of the vicinity of the ink ejection opening of the ink ejection nozzle 20, the ink droplets are repelled on the surface and does not deposit thereon. Therefore, when ink droplets are ejected, the ejecting directions of them are not delicately varied because there is no ink deposited on the ink ejection opening, which affects ejecting directions of ink droplets.

Even if ink deposites on the surface of the vicinity of the ink ejection opening and the fine irregular surface 22*a* is worn by a cleaning blade which slides thereon to remove the ink deposited thereon, the fine irregular surface 22*a* composed of the fine particles 23 is formed because the fine particles 23 are uniformly dispersed in the plate 22 and exposed on the fine irregular surface 22*a* at all times. Therefore, even if the inkjet head is used for a long period of time, the ejecting directions of ink droplets can be stabilized.

In the plate 22 of the embodiment, the fine particles, which are mainly composed of silicone and have the water-repellent function, are approximately uniformly dispersed in the plate base member. The present invention further provides an inkjet head including a different plate in place of the plate 22, the different plate being arranged such that fine particles having a water-repellent function are dispersed therein in such a manner that the density of the fine particles on the back surface of the plate opposite to the ink ejection surface thereof is smaller than that of the fine particles on the ink ejection surface.

A preferable embodiment of the inkjet head has an ink ejection mechanism arranged similarly to the ink ejection mechanism 14 shown in FIG. 3 except the plate 22.

Figure 4A:
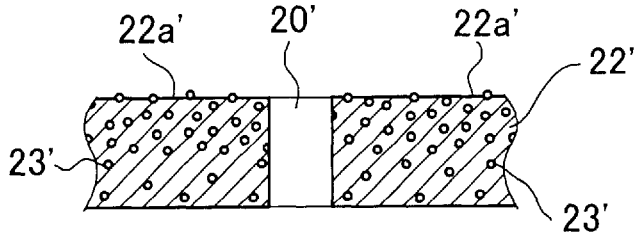
FIGS. 4A and 4B are views explaining another embodiment of the inkjet head of the present invention.

For example, a plate 22' as shown in FIG. 4A is used in place of the plate 22.

The plate 22' has an ink ejection nozzle 20' similarly to the plate 22, and a resin material that is widely used in a polymer film is used as the plate base member of the plate 22'. For example, thermosetting resins such as polyimide, polyurethane resin, etc., thermoplastic resins such as polysulfone, etc., and further aramid resin are used as the plate base member.

Further, fine particles 23', which are composed of silicone, fluoride oligomer, fluoride polymer, or fluoride graphite and have a water-repellent function, are dispersed in the plate 22' such that the dispersing density of the fine particles 23' is gradually reduced from the ink ejection surface of the plate 22' to the back surface thereof and almost no fine particle exists on the back surface of the plate 22'. That is, the plate 22' has such an inclining effect that an effect of water repellency based on the fine particles 23' exists on the ink ejection surface as well as the effect of water repellency is lost on the back surface. Note that it is preferable that the particle size of the fine particles 23' be 1 $\mu$m or less similarly to the fine particles 23 and that the dispersing density of the fine particles 23' be $3\times10^7$ (pieces/mm$^3$) or more. The plate 22' can be made by forming a multi-layered polymer film by coating polymer film-forming solutions in a molten state in each of which the fine particles 23' are dispersed at a different dispersion density.

Further, the fine particles 23' are exposed on the surface of plate 22' on the ink ejection opening side (front surface side) thereof similarly to the plate 22, and a fine irregular surface 22*a'* is formed thereby. The fine irregular surface 22*a'* may be formed on the entire front surface of the plate 22' on the ink ejection side of an ink ejection nozzle 20' or may be formed within a predetermined region of the ink ejection opening of the ink ejection nozzle 20'.

Figure 4B:
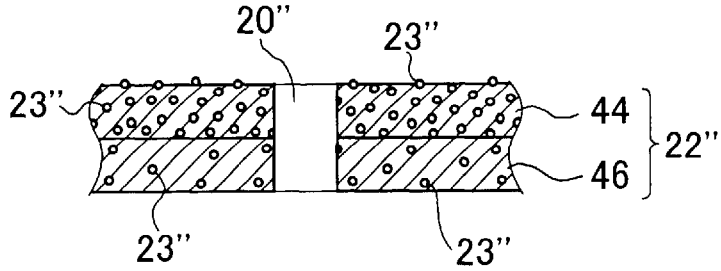

Further, as shown in FIG. 4B, a plate 22" may be used in place of the plate 22', the plate 22" being formed of multi-layered films 44 and 46 which have a different dispersion density of fine particles 23" composed of silicone, fluoride oligomer, fluoride polymer, fluoride graphite, etc. having a water-repellent function. In the plate 22", the dispersion density of the fine particles 23" is reduced stepwise from the ink ejection surface side thereof. The plate 22" is made by, for example, laminating films each having a different dispersion density of the fine particles 23" just after the films are produced in an extrusion process.

A flat surface similar to the flat surface 22*b* is formed on the inner surface of each of the ink ejection nozzles 20' and 20".

With this arrangement, neither ink repellency based on the water-repellent fine particles nor ultra ink repellency based on the irregular shape of the the plates 20' and 20" is realized on the back surface side of each of the the plates 20' and 20" opposite to the ink ejection surface side thereof. Thus, the plates 20' and 20" can be bonded well on a partition layer because an adhesive can be easily coated. Therefore, even if the inkjet head is used for a long period of time, the plates 20' and 20" are not exfoliated from the partition layer and ink droplets are ejected stably, and thereby a print of an image of high quality can be output.

The plate of the embodiment is arranged such that the fine particles 23, 23", for example which are mainly composed of silicone and have the water-repellent function, are dispersed in the plate base member. However, the present invention may employ a plate in which fine particles having a water-repellent function are dispersed at least in the region near to the surface of the plate on the ink ejection side thereof. This plate is etched using at least two kinds of etching conditions which differ as to magnitude relation between an etching rate of the fine particles located in the region near to the surface and an etching rate of the portion of the plate other than the fine particles in the region, and thereby an ink ejection nozzle and the surface of the plate in the vicinity of the ink ejection opening of the ink ejection nozzle are formed. When the portion of the plate other than the fine particles is composed of multiple composite materials, an etching condition in which all of etching rates of the multiple composite materials are faster than that of the fine particles and an etching condition in which all of etching rates of the multiple composite materials are approximately the same as that of the fine paritcles, are preferably used as the two kinds of etching conditions.

Figure 5:
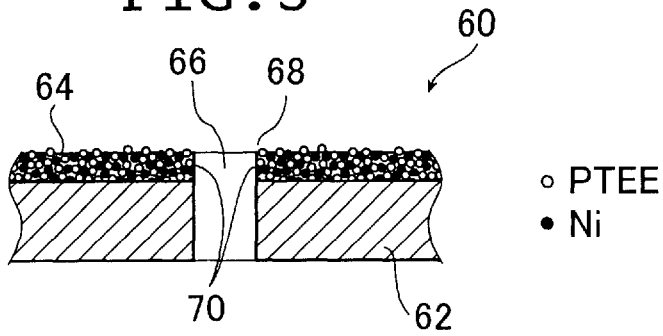
FIG. 5 is a view explaining a still another embodiment of the inkjet head of the present invention.
Figure 6:
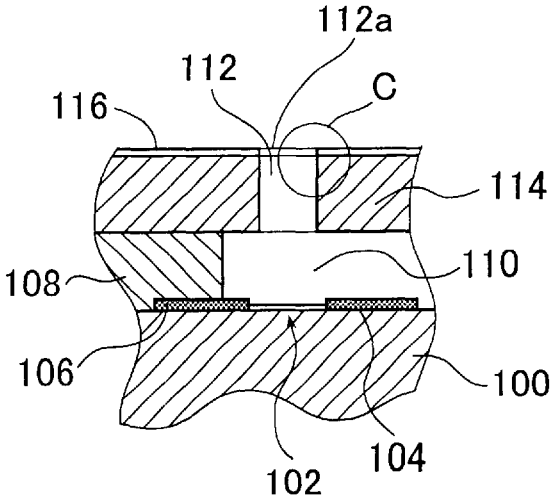
FIG. 6 is a view explaining an arrangement corresponding to an ink ejection nozzle of a conventional inkjet head.
Figure 7:
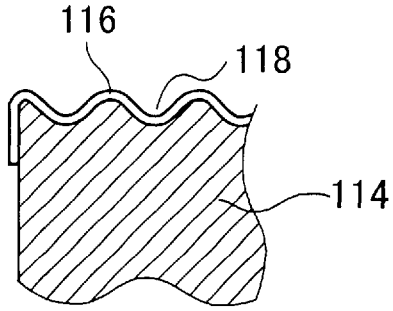
FIG. 7 is an enlarged sectional view of a region C of the inkjet head shown in FIG. 5.

FIG. 5 is a sectional view of a plate 60 in which fine particles having a water-repellent function are dispersed in the region near to the surface of the plate 60 on the ink ejection side thereof.

The plate 60 is composed of a plate base member 62 and an eutectoid plated film 64 disposed on the plate base member 62 in the region near to the surface of the plate 60 on the ink ejection side thereof from which an ink droplet is ejected. The eutectoid plated film 64 is composed of Ni (nickel) and PTFE (polytetrafluoroethylene) which acts as fine particles having a water-repellent function. A fine irregular surface 68, which is arranged by the exposed fine particles of PTFE, is formed on the surface of the plate 60 in the vicinity of the ink ejection opening of an ink ejection nozzle 66, that is, on the surface of the eutectoid plated film 64 in the vicinity of the ink ejection opening. The fine particles of PTFE are not exposed on the inner surface of the ink ejection nozzle 66, and a flat surface 70 with no fine irregular portion is formed on the inner surface such that the fine particles of PTFE are flush with Ni on the inner surface.

The plate 60 arranged as described above is etched using at least the two kinds of etching conditions which differ in magnitude relation between an etching rate of the fine particles of PTFE and an etching rate of the Ni. Thus, the ink ejection nozzle 66 is formed (a hole is made) as well as the surface of the plate 60 is arranged as the fine irregular surface 68 in the vicinity of the ink ejection opening of the ink ejection nozzle 66.

An inkjet head using the plate 60 has an ink ejection mechanism in which the plate 60 is used in place of the plate 22 shown in FIG. 3. Therefore, the description of the arrangements and functions of the respective components other than the plate 60 of the inkjet head is omitted.

The plate 60 is arranged such that the eutectoid plated film 64 of Ni and PTFE is formed on the surface of the plate base member 62 on the ink ejection side thereof. The eutectoid plated film 64 is formed in a thickness of, for example, 1 to 5 $\mu$m, and the thickness of the plate base member 62 including the eutectoid plated film 64 is set to several tens of micrometers. The material of the plate base member 62 is not particularly limited, and resin materials such as polyimide, polyurethane resin, polysulfone, aramid, etc., a glass material, and the like may be used.

The eutectoid plated film 64 is a known composite Ni plated film formed on the plate base member 62 by plating performed using a Ni plating solution in which fluorine resin is dispersed.

The ink ejection nozzle 66 of the plate 60 is formed by dry etching by defining the hole under an etching condition in which Ni and PTFE have approximately the same etching rate, for example, in an Ar gas atmosphere. The flat surface 70 is formed on the inner surface of the ink ejection nozzle 66. Further, etching may be performed in the atmosphere of the mixed gas of Ar and $O_2$ that are regulated to a predetermined ratio to make the etching rate of PTFE approximately similar to that of Ni. The etching condition may be optionally determined as long as the etching rate of the fine particles of PTFE having the water-repellent function is approximately the same as that of Ni surrounding the fine particles.

In contrast, the fine irregular portion of the surface of the ink ejection nozzle 66 in the vicinity of the ink ejection opening thereof is formed such that PTFE is exposed on the surface by etching Ni selectively in a wet etching process using a solution of one kind of, for example, nitric acid, phosphoric acid, hydrochloric acid and acetic acid or a solution of a mixture thereof. In this case, it is desirable to perform the wet etching by previously masking the ink ejection nozzle 66 to prevent the flat surface 70 on the inner surface, which has been formed, of the ink ejection nozzle 66 from being etched.

It should be noted that while the plate is etched using the two kinds of etching conditions which differ in magnitude relation between an etching rate of the PTFE and the Ni in the above example, the plate may be etched using two or more kinds of etching conditions in the present invention.

Further, the eutectoid plated film 64 is not particularly limited. That is, the eutectoid plated film 64 may be a fluoride graphite composite plated film that is obtained by plating performed using a Ni plating solution in which the fine particles of fluoride graphite are dispersed, in addition to the eutectoid plated film of PTFE and Ni.

While the inkjet head and the method of manufacturing the inkjet head of the present invention have been described above in detail, the present invention is by no means limited to the above embodiments and it goes without saying that various improvements and modifications can be made within the range which does not depart from the gist of the present invention.

As described above in detail, the plate, through which the ink ejection nozzle of the inkjet head is formed and which contains the fine particles that has the water repellent function and is dispersed in at least the region near to the surface of the plate on the ink ejection side thereof, is produced by an etching process using at least the two kinds of the etching conditions which differ in magnitude relation between an etching rate of the fine particles in the region near to the surface and an etching rate of the portion of the plate excluding the fine particles. When, for example, the plate is etched using an etching condition in which the etching rate of the plate base member is approximately the same as that of the fine particles and an etching condition in which the etching rate of the plate base member is faster than that of the fine particles, the ink ejection nozzle the inner surface of which is arranged as the flat surface is formed as well as the surface of the plate in the vicinity of the ink ejection opening of the ink ejection nozzle is formed as the fine irregular surface. As a result, the plate, in which the inner surface of the ink ejection nozzle does not have the ultra ink repellency and the vicinity of the ink ejection opening of the ink ejection nozzle has the ultra ink repellency, can be easily formed. Accordingly, even if the inkjet head is used for a long period of time, the ultra ink repellency for an ink droplet can be maintained, and thereby a print having high image quality can be output.

Further, since the density of the water-repellent fine particles on the back surface of the plate opposite to the ink ejection surface thereof is lower than that of the water-repellent fine particles on the ink ejection surface, the plate can be firmly bonded on the partition layer by an adhesive. Therefore, even if the inkjet head is used for a long period of time, the plate is not exfoliated from the partition layer. As a result, an ink droplet can be ejected stably and an image of high quality can be printed and output.

What is claimed is:

1. An inkjet head, comprising:

an ink ejection unit; and a plate including an ink ejection nozzle disposed in correspondence to the ink ejection unit so that an ink droplet is ejected from the ink ejection nozzle using the ink ejection unit, wherein, fine particles which have a water-repellent function are dispersed in at least a region in proximity to a surface of the plate on an ink ejection side thereof; and wherein the plate is etched using at least two kinds of etching conditions which differ in magnitude relation between an etching rate of the fine particles in the region and an etching rate of the portion of the plate other than the fine particles in the region, and thereby the ink ejection nozzle and the surface of the plate in a vicinity of an ink ejection opening of the ink ejection nozzle are formed.

2. The inkjet head according to claim 1, wherein the plate is arranged such that the fine particles are dispersed in a plate base member, and the plate is etched using an etching condition in which an etching rate of the plate base member is approximately equal to that of the fine particles and an etching condition in which an etching rate of the plate base member is faster than that of the fine particles.

3. The inkjet head according to claim 1, wherein the fine particles having the water-repellent function comprises silicone.

4. The inkjet head according to claim 1, wherein a fine irregular surface where the fine particles are exposed is formed on the surface of the plate in the vicinity of the ink ejection opening of the ink ejection nozzle.

5. The inkjet head according to claim 1, wherein a flat surface with no fine irregular portion is formed on an inner surface of the ink ejection nozzle.

6. An inkjet head, comprising:

an ink ejection unit; and a plate including an ink ejection nozzle disposed in correspondence to the ink ejection unit so that an ink droplet is ejected from the ink ejection nozzle using the ink ejection unit, wherein the plate is arranged such that fine particles, which comprises silicone, are dispersed in a plate base member.

7. The inkjet head according to claim 6, wherein the plate is etched using an etching condition in which an etching rate of the plate base member is approximately equal to that of the fine particles and an etching condition in which an etching rate of the plate base member is faster than that of the fine particles.

8. An inkjet head, comprising:

an ink ejection unit; and a plate including an ink ejection nozzle disposed in correspondence to the ink ejection unit so that an ink droplet is ejected from the ink ejection nozzle using the ink ejection unit, wherein the plate contains fine particles having a water-repellent function and dispersed therein, and the dispersion density of the fine particles on a back side of the plate opposite to an ink ejection side thereof from which the ink droplet is ejected is lower than that of the fine particles on the ink ejection side.

9. A method of manufacturing an inkjet head comprising an ink ejection unit disposed on a substrate and a plate including an ink ejection nozzle disposed in correspondence to the ink ejection unit and containing fine particles, which have a water-repellent function and are dispersed in at least a region in proximity to a surface of the plate on an ink ejection side thereof, so that an ink droplet is ejected from the ink ejection nozzle using the ink ejection unit, the method comprising the steps of:

bonding the plate along the substrate before the ink ejection nozzle is formed through the plate;

forming the ink ejection nozzle under a first etching condition in which an etching rate of the fine particles in the region in proximity to the surface and an etching rate of a portion of the plate other than the fine particles in the region have predetermined magnitude relation so that the inner surface of the ink ejection nozzle is arranged as a flat surface; and etching the surface of the plate under a second etching condition which has magnitude relation different from the magnitude relation of the first etching condition so that the surface of the plate in a vicinity of an ink ejection opening of the thus formed ink ejection nozzle is arranged as a fine irregular surface on which the fine particles are exposed.

10. The method of manufacturing an inkjet head according to claim 9, wherein the first etching condition is such that the etching rate of the fine particles in the region in proximity to the surface is approximately equal to that of the portion of the plate other than the fine particles, and the second etching condition is such that an etching rate of the portion of the plate other than the fine particles is faster than that of the fine particles.

11. The method of manufacturing an inkjet head according to claim 10, wherein the ink ejection nozzle is formed by dry etching using a gas containing oxygen and fluorine as a reaction gas, and the surface of the plate is processed by dry etching using an oxygen gas as a reaction gas.

* * * * *